United States Patent [19]

Feuz et al.

[11] Patent Number: 4,957,047

[45] Date of Patent: Sep. 18, 1990

[54] CABLE TRANSPORT INSTALLATION

[75] Inventors: Fritz Feuz, Thun; Walter Brawand, Bönigen, both of Switzerland

[73] Assignee: Von Roll Transportsysteme AG, Thun, Switzerland

[21] Appl. No.: 427,992

[22] Filed: Oct. 27, 1989

Related U.S. Application Data

[63] Continuation of Ser. No. 172,421, Mar. 23, 1988, abandoned.

[30] Foreign Application Priority Data

Mar. 25, 1987 [CH] Switzerland ..... 144/87

[51] Int. Cl.[5] ..... B61B 12/12

[52] U.S. Cl. ..... 104/204; 104/112; 104/211; 104/214

[58] Field of Search ..... 104/89, 112, 173.1, 104/173.2, 202, 204, 205, 206, 209, 211, 214, 215, 217, 218, 220, 224, 27, 28

[56] References Cited

U.S. PATENT DOCUMENTS

| | | | |
|---|---|---|---|
| 406,928 | 7/1889 | Michales | 104/220 |
| 479,920 | 8/1892 | Pendleton | 104/205 |
| 479,921 | 8/1892 | Pendleton et al. | 104/218 |
| 2,591,680 | 4/1952 | Dachkevitch . | |
| 2,682,838 | 7/1954 | Dumur | 104/205 X |
| 3,854,407 | 12/1974 | Cocroft | 104/112 |
| 4,473,011 | 9/1984 | Wuschek | 104/112 X |
| 4,653,406 | 3/1987 | Levi | 104/211 |
| 4,760,798 | 8/1988 | Blengini | 104/209 |

FOREIGN PATENT DOCUMENTS

| | | | |
|---|---|---|---|
| 207892 | 3/1960 | Austria | 104/204 |
| 833195 | 3/1952 | Fed. Rep. of Germany | 104/202 |
| 858706 | 10/1952 | Fed. Rep. of Germany . | |
| 367200 | 3/1963 | Fed. Rep. of Germany . | |
| 1249949 | 11/1959 | France . | |
| 2288658 | 10/1974 | France . | |
| 117106 | 10/1926 | Switzerland . | |
| 1142011 | 2/1969 | United Kingdom | 104/202 |
| 2041305 | 9/1980 | United Kingdom | 104/173.1 |

*Primary Examiner*—Margaret A. Focarino
*Assistant Examiner*—Joseph A. Pape
*Attorney, Agent, or Firm*—Cushman, Darby & Cushman

[57] ABSTRACT

The revolving cable transport installation, for instance a gondola aerial cableway, has the carriages of the gondolas supported upon two adjacently extending support cables. Between both support cables there is arranged a continuously revolving traction cable. Along the travel path the carriages are coupled with the continuously revolving traction cable by actuatable cable clamps. These cable clamps are connected with the carriages so as to be elevationally movable and they engage the traction cable from below. The traction cable extends at the upper region of the carriages and can support itself within the suspension zones, i.e. between the support masts at the carriages. Thus, the weight of the traction cable does not load the cable clamps and these cable clamps can accommodate themselves to the position of the traction cable independent of the carriages. Due to supporting of the carriages at two support cables, the cable transport installation is less sensitive to wind loads and there results a quieter and stabler travel of the gondolas.

15 Claims, 3 Drawing Sheets

Fig.1
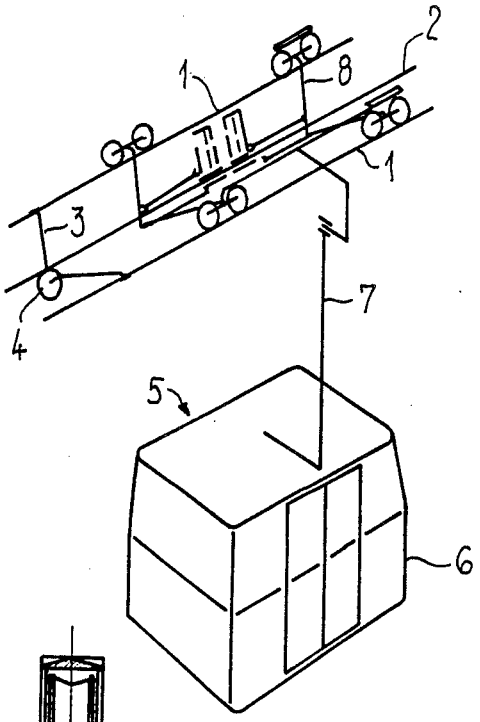
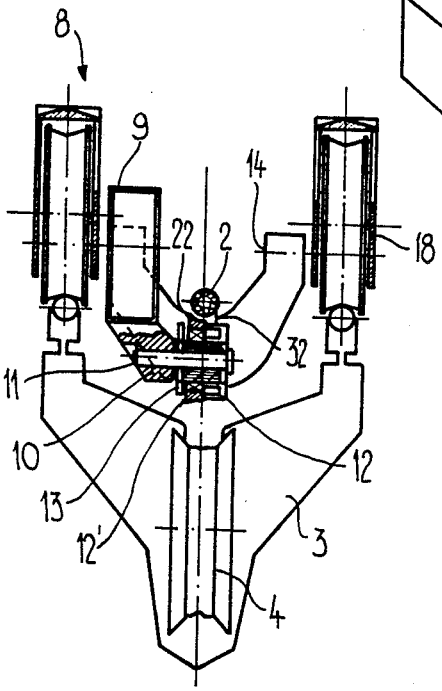
Fig.6

CABLE TRANSPORT INSTALLATION

This is a continuation of application Ser. No. 07/,172,421, filed March 23, 1988, which was abandoned upon the filing hereof.

BACKGROUND OF THE INVENTION

The present invention relates to a new and improved construction of a cable transport installation, and more particularly, to an aerial cable or cableway transport installation, sometimes also referred to in the art as an aerial ropeway transport installation.

Generally speaking, the aerial cable transport installation of the present development is of the type comprising a plurality of cables or ropes and vehicles, such as gondolas by way of example and not limitation. The carriages of the vehicles can be coupled with a revolving traction or towing cable or rope by means of actuatable cable or rope clamps or clamp devices.

Particularly in the field of so-called sport or athletic transport installations, the capacity of aerial cable transport installations has markedly increased in the last decades consonant with the widespread popular enthusiasm for skiing as well as mountaineering. Also the revolving transport installations have attempted to keep pace with such developments by increasing the conveying capacity and the travel velocity in that conventional systems, that is to say, the single cable transport installations and double cable (one support cable and one towing cable) transport installations, have been reinforced by appropriate system design in accordance with the greater demands placed upon such transport installations or systems. However, it has been found that the increase in the conveying capacity, predicated upon conventional designs of the transport installations, while maintaining the requirements concerning travel safety, are subject to certain limitations and, if anything, the travel comfort for the passengers tends to decrease.

SUMMARY OF THE INVENTION

Therefore with the foregoing in mind it is a primary object of the present invention to provide a new and improved construction of a cable transport installation which does not suffer from the aforementioned drawbacks and shortcomings of prior art constructions.

Another and more specific object of the present invention, aims at the provision of a new and improved construction of an aerial cable transport installation which simultaneously affords enhanced travel security and comfort for the passengers by improving the stability and quiet running of the vehicles of the aerial cable transport installation.

Yet a further significant object of the present invention, is directed to an improved aerial cable transport installation employing two support cables or ropes and intermediate thereof a traction or towing cable or rope, the carriages of the vehicles travelling upon the support cables or ropes and being towed by clamps engaging with the traction or towing cable or rope, wherein the manner of coaction and selective engagement and disengagement of the clamps with the traction cable or rope, affords enhanced flexibility in the design of the cable transport installation, particularly at the stations so that the passengers in the vehicles experience a greater feeling of security and comfort by virtue of improved travel stability of the vehicles and reduced deflections or vehicle motion which otherwise would be discomforting to the passengers.

A still further noteworthy object of the present invention is concerned with a new and improved construction of an aerial cable transport installation which is relatively simple in design, relatively economical to manufacture, extremely reliable in operation, not readily subject to breakdown or malfunction, and affords enhanced travel comfort for the vehicle passengers of the aerial cable transport installation.

Now in order to implement these and still further objects of the invention, which will become more readily apparent as the description proceeds, the aerial cable transport installation of the present development is manifested, among other things, by the features that, the traction or towing cable or rope extends between two horizontally spaced support or supporting cables or ropes and that the cable or rope clamps are connected to be elevationally movable with the vehicle carriages which are supported at both of the support cables or ropes.

In the context of this disclosure, it is to be understood that when referring to the support cables or ropes being horizontally spaced, what is meant is the distance as measured between the support cables in generally horizontal direction. Stated in a different manner, each of the support cables can be deemed to be located in an upright or vertical plane and the aforementioned horizontal spacing or distance would then be the distance measured between such planes.

In any event, by virtue of the novel construction of aerial cable transport installation according to the present development there is realized, apart from the increased stability which is obtained by supporting the carriages at both support cables or ropes, the further beneficial effect that the weight of the traction or towing cable or the like, located between the support cables and engaging at the carriages has a stabilizing effect.

Moreover, the elevational mobility of the cable clamps or clamp devices renders it possible to alter the elevational course of travel of the traction or towing cable relative to that of the support cables. This is particularly of significance at the stations when the vehicle carriages are disconnected from the traction or towing cable or again connected or engaged therewith. Due to the movable arrangement of the cable clamps or clamp devices relative to the vehicle carriages, there is no need to deflect or otherwise undesirably alter the course of travel of the vehicles and it is only necessary to move the mass of the cable clamps or clamp devices which is relatively modest.

Furthermore, it is advantageous when the traction or towing cable extends above the vehicles and the cable clamps or clamp devices engage the traction or towing cable from below. This beneficially allows guiding the traction or towing cable at the stations above the carriages or vehicles, in other words, to deflect or drive, as the case may be, the traction or towing cable and thus to save space in the station buildings or structures.

The carriages constructed according to the invention are preferably provided with support devices or supports for the traction or towing cable which advantageously are arranged forwardly or upstream and behind or downstream of the cable clamps or clamp devices. These cable clamps or clamp devices are thus freed of the task of taking up within the cable suspension zones, in other words, the region between the support masts or the like where the cables are suspended, the load of the through-hanging traction or towing cable and transmitting such to the vehicle carriages.

These support devices for the traction or towing cable are preferably arranged at each carriage in such a fashion that the corresponding support forces can be transmitted by the travel wheels of the carriages directly to the support cables without as far as possible loading any other parts or components.

BRIEF DESCRIPTION OF THE DRAWINGS

The invention will be better understood and objects other than those set forth above will become apparent when consideration is given to the following detailed description thereof. Such description makes reference to the annexed drawings depicting by way of example a three-cable revolving cable transport installation wherein throughout the various figures of such drawings, there have been generally used the same reference characters to denote the same or analogous components and wherein:

FIG. 1 schematically illustrates in part the aerial cable transport installation showing the cable or rope arrangement and one of the vehicles;

FIG. 6 is a simplified cross-sectional view of the arrangement of FIG. 3, taken substantially along the section line VI—VI thereof.

DETAILED DESCRIPTION OF THE PREFERRED EMBODIMENTS

Figure 2:
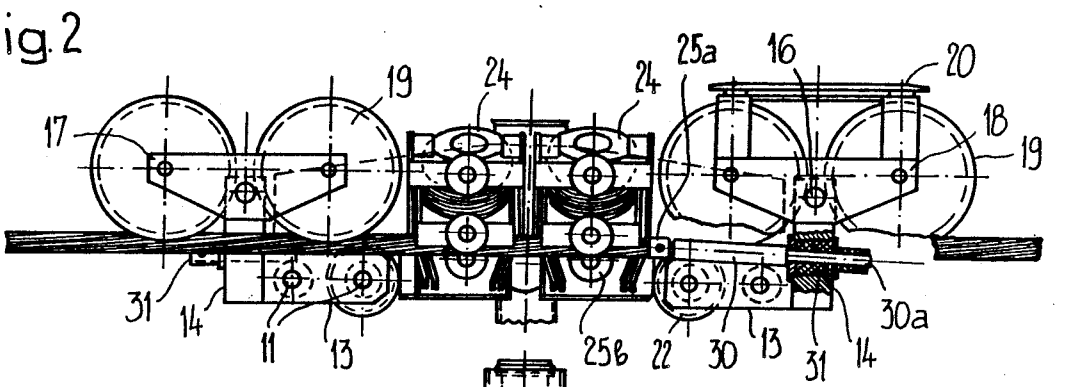
FIG. 2 illustrates in elevational view a carriage or carriage unit of a vehicle employed in the aerial cable transport installation of FIG. 1.

Describing now the drawings, it is to be understood that to simplify the showing thereof, only enough of the construction of the exemplary embodiment of aerial cable transport installation, here shown as an aerial cableway, has been illustrated therein as is needed to enable one skilled in the art to readily understand the underlying principles and concepts of this invention.

In the showing of the drawings, the therein depicted aerial cable transport installation can be constituted by a gondola or cabin lift although other types of revolving cable transport installations are equally contemplated, such as chairlifts. Furthermore, the aerial cable transport installation of the present invention can be advantageously used in other fields of application apart from transporting or conveying passengers, for instance for transporting goods or materials.

Turning now specifically to FIG. 1 of the drawings, it will be seen that the revolving aerial cable transport installation, here depicted as a gondola lift purely by way of example and not limitation, comprises a plurality of support cables or ropes 1, and at least one traction or towing cable or rope 2 which is continuously in revolving motion during operation of the aerial cable transport installation. In particular, in the exemplary embodiment depicted in FIG. 1 there has been shown a construction employing two support cables or ropes 1 and one traction cable or rope 2. The traction cable or rope 2 is arranged centrally between or intermediate both of the support cables or ropes 1 which, in turn, are constituted by tensioned support cables or ropes horizontally spaced from one another at the same height or elevational position. The traction cable or rope 2 travels at the suspension zones between the support masts or the like, over a number of rollers 4 of intermediate substantially V-shaped supports or support devices generally designated by reference character 3, as particularly well seen by referring to FIGS. 1 and 6. These substantially V-shaped intermediate supports 3 are fixedly clamped from below at the support cables or ropes 1 and rigidly interconnect with one another the spaced support cables or ropes 1.

Continuing, reference numeral 5 generally designates a vehicle or conveyance unit of the aerial cable transport installation, here shown by way of example and not limitation as a gondola whose cabin 6 is supported by means of a suitable suspension device 7 at an associated carriage or carriage unit 8. The construction of each of these carriages or carriage units 8, likewise constituting subject matter of the present development, has been illustrated in greater detail in FIGS. 2 to 6 and will be described with greater particularity in conjunction therewith in the disclosure to follow.

Figure 3:
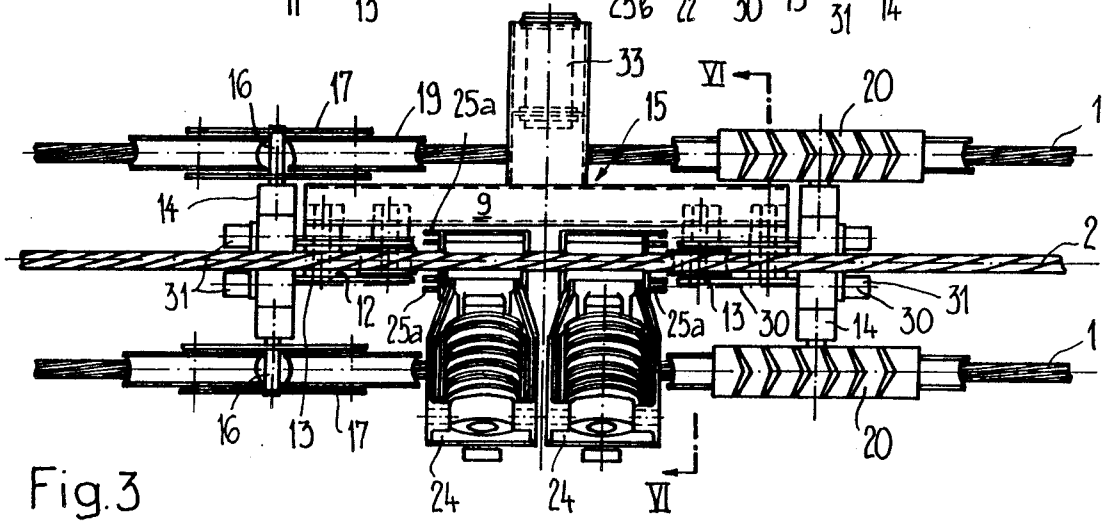
FIG. 3 is a top plan view of the carriage or carriage unit depicted in FIG. 2.

As will be observed by referring to, for instance, FIGS. 2, 3, 4 and 5, a longitudinal support or carrier member 9, which in cross-section is of substantially box-like or girder-like configuration, possesses neighboring both of its oppositely situated ends two respective pin members or pins 11 which are rigidly secured to associated brackets or bracket members 10. The axes of all of these pin members 11 or equivalent structure are located in a common essentially horizontal plane as shown in the illustration of FIG. 2. Each of the two pin members 11 at each of the opposite ends of the longitudinal support or carrier member 9 engage in a respective elastic element 12 and 12' (FIG. 6) which, in turn, are arranged in an associated bifurcated or substantially fork-shaped arm member 13. As shown in FIGS. 2 and 3 each of both arm members or arms 13 is rigidly connected with a respective substantially U-shaped transverse carrier or support member 14. However, the elastic elements 12 and 12' allow for a limited mobility of the related transverse carrier or support member 14 in all directions relative to the longitudinal support or carrier member 9 and, in particular, a rocking or pivoting of the transverse carriers or support members 14 independently of one another about the lengthwise axis of the longitudinal support or carrier member 9. The components or parts 9 to 14 thus collectively form a frame or frame unit 15 of the associated carriage 8 which can twist or undergo a torsional movement about an axis extending in lengthwise direction.

As will be also observed by referring to FIG. 3, at each of the transverse carriers or support members 14 there are pivotably secured by means of the shafts or axles 16 two rocker members or rockers 17 and 18, respectively. Each of such rockers or rocker members 17 and 18 possesses two rotatably mounted travel wheels or rolls 19 or equivalent structure. The pairs of travel wheels 19 of each of the rockers or rocker members 17 and 18 of the related transverse carrier or support member 14 are arranged at the same spacing from one another as the distance or spacing between the support cables 1 or, as the case may be, the support rails or rail members 1' (FIG. 4) which are correspondingly arranged at the stations.

Figure 4:
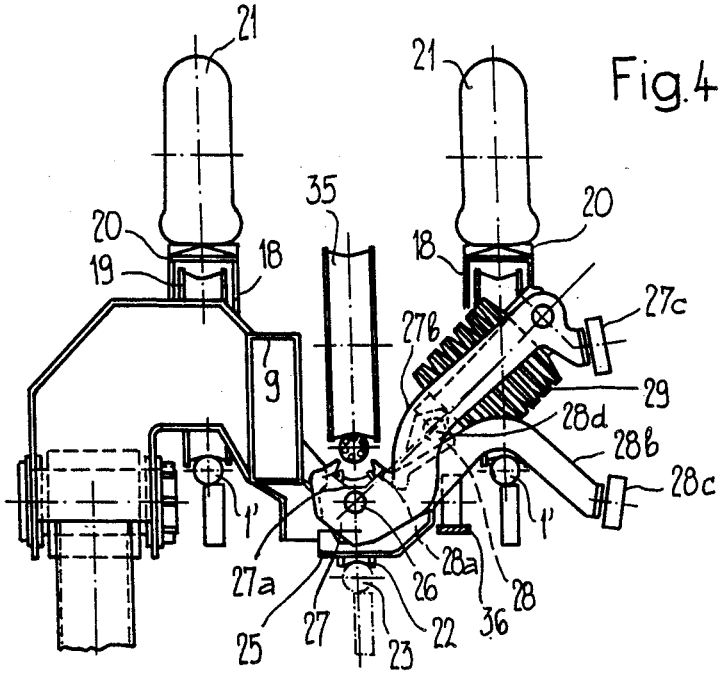
FIG. 4 is a cross-sectional view through the carriage or carriage unit depicting the cable clamps in an opened position or condition.

It is here further remarked that the rockers or rocker members 18 of the pair of travel wheels 19 which are forwardmost or leading in the direction of vehicle travel, in contrast to the other rockers or rocker members 17, are equipped with friction shoes 20 or equivalent friction elements. At these friction shoes 20 there can frictionally engage driven friction wheels 21 or the like provided at the stations as indicated in FIG. 4, in order to conventionally move the vehicles 5 which have been decoupled from the traction or towing cable 2, in other words, to appropriately drive and accelerate or decelerate such decoupled vehicles 5 as is well known in this technology. In each of the bifurcated or fork-shaped arm members 13 there is seated at the innermost of the two elastic elements 12 and 12', which innermost elastic element has been designated by reference character 12' in FIG. 6, a further travel wheel or roll 22. Both of these travel wheels or rolls 22 constitute auxiliary wheels or rolls for the associated vehicle 5 and, more specifically stated, the carriage or carriage member 8 thereof for travel of such vehicle 5 and its carriage member 8 through curved portions of the aerial cable transport installation, for instance specifically at the end stations located at the foot of the mountain or at the top of the mountain by way of example. At each such station, these travel wheels or rolls 22 coact with a deflection or turning rail member 23 which replaces the support rails 1' at the curved portions of the station, as has been indicated in FIG. 4.

As will be observed by reverting to FIGS. 2, 3 and 4, each carriage or carriage unit 8 possesses two cable or rope clamps or :lamp devices 24 arranged in the vehicle lengthwise director between the arm members 13. Each of the cable clamps or clamp devices 24 comprises a clamp housing 25 in which there are pivotably mounted by means of a shaft or axle 26 piercingly extending through the clamp housing 25 two clamp or clamping portions 27 and 28. Each of these clamp portions or components 27 and 28 comprises a clamp jaw or jaw member **27*a* and 28*a*, respectively, a bowed or curved clamping lever or lever member 27*b* and 28*b*, respectively, which protrudes laterally past the rocker members 17 and 18 and an actuation roll or roller 27*c* and 28*c*, respectively, mounted at the free end of these clamp levers or lever members 27*b* and 28*b*, respectively. These clamp or clamping levers 27*b* and 28*b* are constructed as brackets, and between the legs of the clamping lever 27*b* there are arranged the clamp jaw 28*a* and the clamping lever 28. Between the pairs of legs of both clamp or clamping levers 27 and 28 there is also arranged a packet 29 of plate springs or the like, which is hingedly supported at the clamping lever 27*b* by means of a pin 27*d* and at the clamping lever 28*b* by means of a pin 28*d*. As will be apparent from the position of the pin or pin member 28*d* shown in FIG. 4, when the associated clamp or clamp device 24 is opened, and the illustration of FIG. 5 when the associated clamp or clamp device 24 is closed, this component forms or constitutes a toggle joint or toggle lever structure which during the opening and closing movements of the clamp or clamping jaws 27*a* and 28*b* moves through a dead-center position in opposition to the action of the plate spring packet 29 applying the clamping force. In the open position of the clamping portions 27 and 28 such bear against not particularly illustrated stops or abutments provided at the related clamp housing 25**.

According to an important aspect of the present invention, the cable or rope clamps or clamp devices 24 are not rigidly but instead movably connected with the frame or frame unit 15, and such mobility is independent of the opening or closing movement, as the case may be, of the clamping jaws **27*a* and 28*a*. To that end, the clamp housings 25 are each hingedly connected by pairs of brackets 25*a* arranged at opposite sides of each related clamp housing 25 with an associated guide member or guide 30, as best seen by referring to FIG. 2. Each such guide member or guide 30 engages by means of two mutually spaced rods or rod members 30*a* in two elastic bushings or sleeves 31. These elastic bushings or sleeves 31 are inserted into the associated transverse carriers or support members 14 at the same height to both sides of the vertical central plane of the vehicle 5. Consequently, both of the cable clamps or clamp devices 24 are axially and vertically movable independently of one another through a limited extent by means of the guides or guide members 30 which can deflect or move in relation to the transverse carriers or support members 14. Furthermore, it will be observed that the clamping jaws or jaw members 27*a* and 28*a* engage from below the traction or towing cable or rope 2 and these clamping jaws 27*a* and 28*a* open and close by undertaking a movement transverse to the vertical direction of mobility thereof. It is also to be remarked that between the guides or guide members 30 and the clamp housings 25 or their bracket pairs 25*a* there are incorporated further conventional elastic elements (not shown) which in the normal work position of the guide members 30 retain the axes or shafts 26 of the clamping jaws 27*a* and 28*a* substantially parallel to the lengthwise axis of the vehicle 5 and thus with respect to the traction or towing cable 2 in order to engage such traction or towing cable 2 in an axially aligned disposition during the closing movement of the clamping jaws 27*a* and 28*a***.

Figure 5:
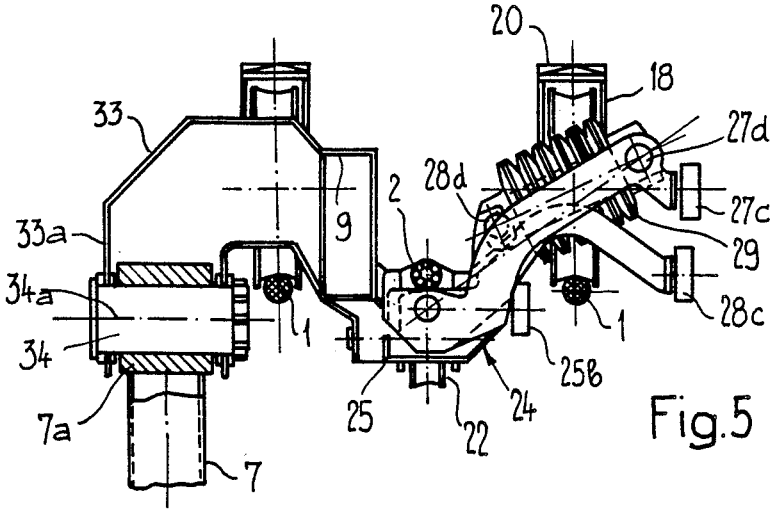
FIG. 5 is a cross-sectional view, like the illustration of FIG. 4, through the carriage or carriage unit but this time depicting the cable clamps in the closed position or condition.

As will be observed by referring to FIGS. 4 and 5, the clamp housing 25 of each cable clamp or clamp device 24 supports an adjustment roll or roller **25*b* or the like, by means of which there can be influenced the position of such cable clamps 24. At the stations there are provided suitable and thus not particularly illustrated actuation rails or rail members or equivalent structure in order to open, or for that matter to close, as the case may be, by means of the actuation rolls or rollers 27*c* and 28*c* the clamping jaws 27*a* and 28*a*, respectively. At each of the stations a cam track or track member 36 is disposed, viewed in the direction of vehicle travel, behind or downstream of the actuation rail contemplated to open the clamps or clamp devices 24. Also forwardly or upstream of the actuation rail contemplated for closing of the clamps or clamp devices 24 there is disposed a cam track or track member 36. These cam tracks or track members 36 lower or raise, as the case may be, the clamps or clamp devices 24 in the open state of the clamping jaws 27*a* and 28*a* by means of the adjustment roll or roller 25*b* out of or into the elevational region of the traction or towing cable 2**.

The lowest point of the traction or towing cable 2 with respect to the carriage or carriage unit 8 is defined by the support members 32 which are rigidly mounted at the transverse carriers or support members 14 and which transmit downwardly directed resultant traction cable forces by means of the travel rolls 19 as directly as possible to the support cables or ropes 1.

A laterally outwardly protruding support member or cantilever 33 is rigidly secured at the longitudinal support or carrier member 9 approximately at the lengthwise central region thereof and, as best seen by referring to FIGS. 4 and 5, is constructed of substantially yoke-shaped configuration. The support or cantilever 33 engages over or straddles the neighboring support cable or rope 1 in spaced relationship therefrom and carries at its downwardly directed free end 33*a* a bearing bolt or bolt member 34 or equivalent structure which extends substantially parallel to the pin members 11 and which defines a pivot axis 34*a* for the suspension system or device 7. At the upper end of the suspension system or device 7, as will be observed by referring to FIG. 5, there is mounted a bearing eyelet 7*a* or equivalent structure which is pierced by the bearing bolt member 34. By virtue of the substantially yoke-shaped configuration of the cantilever or support member 33, it is possible to transfer the forces resulting from the load directly at the height of the support cables 1 to the vehicle carriage 8, where the traction or towing cable 2 at such height or elevation also engages at the vehicle carriage 8. By way of completeness, it is mentioned that the suspension device or system 7 together with the cantilever member 33 is additionally connected by means of a not particularly depicted but conventional dampening element such that there can be dampened pendulum or oscillating movements of the vehicle cabin 6 about the pivot axis 34*a*.

At the inbound region and outbound region of the stations, the inbound or outbound traction or towing cable 2, as the case may be, which travels over hold-down rolls or hold-up rolls, as the case may be, extends substantially parallel to the rails or rail members 1'. Furthermore, at the inbound side of the station in a first section thereof, there is accomplished decoupling of the vehicles, in other words, the opening of the clamping jaws 27*a* and 28*a* and in a subsequent second section the movement of the clamp or clamp devices 24 by means of the cam tracks engaging at the rolls or rollers 25*b* so as to assume the lowered clamp position depicted in FIG. 4. In the lowered position of the clamp devices 24, the clamp jaws 27*a* and 28*a* can move past a cable guide roll 35 for the traction or towing cable 2 without any collision danger. This cable guide roll or roller 35 has been conveniently depicted in FIG. 4 and serves to accomplish a deflection of the cable upwardly at an inclination above the revolving plane of motion of the carriages 8.

Between the inbound region and the outbound region of a station, the clamps or clamp devices are retained in a rest position by means of the spring or resilient-elastic bushings or sleeves 31 acting upon the guides or guide rods 30 until at an appropriate section or portion of the outbound region of the station they are raised by a cam structure again to the height of the traction or towing cable 2.

Finally, it is mentioned that with the inventive aerial cable transport installation both of the support cables or ropes also could be replaced by support cable pairs in order to increase the stability and/or the support force.

While there are shown and described present preferred embodiments of the invention, it is to be distinctly understood that the invention is not limited thereto, but may be otherwise variously embodied and practiced within the scope of the following claims. Accordingly,

What we claim is:

1. An aerial cable transport installation comprising:

a plurality of cables including two substantially horizontally spaced support cables and a revolving traction cable arranged between said two support cables;

a plurality of vehicles supported by said two support cables and moved by said revolving traction cable;

a carriage for each of said vehicles;

actuatable cable clamp means for each carriage including jaw means for coupling the carriage of each vehicle with the revolving traction cable; and means for displaceably connecting each said jaw means with the corresponding carriage for relative elevational movement therebetween.

2. The aerial cable transport installation as defined in claim 1, wherein:

each carriage has an upper side;

said traction cable extending along the upper side of the carriages; and said actuatable cable clamp means engaging said traction cable from below said traction cable.

3. The aerial cable transport installation as defined in claim 1, wherein:

each said carriage comprises first travel wheels for supporting the carriage at both support cables and second travel wheels arranged intermediate said first travel wheels and a curved deflection rail at a station of the aerial cable transport installation on which travel said second travel wheels.

4. The aerial cable transport installation as defined in claim 3, wherein:

each carriage has a lengthwise axis midway between the support cables; ;and each said carriage ;comprises frame means which can undergo torsional movement about said lengthwise axis.

5. The aerial cable transport installation as defined in claim 4, wherein:

said frame means comprise:

two substantially U-shaped transverse carriers;

a longitudinal support member interconnecting said two substantially U-shaped transverse carriers;

said substantially U-shaped transverse carriers having opposite ends;

rocker means provided at each opposite end of said substantially U-shaped transverse carriers;

said first travel wheels comprising a first pair of travel wheels provided for each of said rocker means;

a suspension system provided for each vehicle;

said suspension system comprising means defining a pivot axis extending approximately at the height of the support cables;

a substantially yoke-shaped cantilever means rigidly connected with said longitudinal support member; and said pivot axis of said suspension system being provided at said substantially yoke-shaped cantilever means.

6. The aerial cable transport installation as defined in claim 5, further including:

friction shoe means provided for the rocker means of one of said substantially U-shaped transverse carriers and arranged above pairs of said travel wheels constituting leading travel wheels of the vehicle.

7. The aerial cable transport installation as defined in claim 1, wherein:

each carriage has a lengthwise direction; said connecting means includes movable lever means for each carriage extending approximately in the lengthwise direction thereof; and said cable clamp means of each carriage is connected with said movable lever means thereof.

8. The aerial cable transport installation as defined in claim 5, wherein:

said cable clamp means comprise two cable clamps for each carriage;

each carriage has a lengthwise direction;

said connecting means comprises movable lever means for each carriage extending approximately in the lengthwise direction thereof; and each of said cable clamps is connected via said movable lever means with a respective one of the substantially U-shaped transverse carriers.

9. The aerial cable transport installation as defined in claim 7, wherein:

said actuatable cable clamp means are structured as toggle joints;

each of said actuatable cable clamp means has a clamp housing provided with an adjustment roll connected to said housing for cooperation with cam means at a station to influence the elevational position of said housing and said clamp means relative to the corresponding carriage;

each of said actuatable cable clamp means includes two clamp jaws each supported for pivotal movement with respect to the other jaw in said housing;

a respective actuation roll operatively connected with each clamp jaw; and said movable lever means engages at said housing of each related actuatable cable clamp means.

10. The aerial cable transport installation as defined in claim 5, wherein:

said actuatable cable clamp means are structured as toggle joints;

each of said actuatable cable clamp means has a clamp housing provided with an adjustment roll;

each of said actuatable cable clamp means includes a clamp jaw; a respective actuation roll operatively connected with each clamp jaw; and said movable lever means engages at said housing of each related actuatable cable clamp means.

11. An aerial cable transport installation comprising:

a plurality of cables;

said plurality of cables comprising two spaced support cables and a movable traction cable arranged between said two spaced support cables;

a plurality of vehicles supported by said two spaced support cables and moved by said movable traction cable;

each of said vehicles having a carriage;

cable clamp means provided for each carriage including jaw means for coupling the carriage of each vehicle with the movable traction cable;

each of said vehicles having a carriage;

cable clamp means provided for each carriage including jaw means for coupling the carriage of each vehicle with the movable traction cable;

said cable clamp means engaging at an underside of said movable traction cable; and means for displaceably connecting each said jaw means with the corresponding carriage for relative elevational movement therebetween.

12. An aerial cable transport installation comprising;

a plurality of cables including two substantially horizontally spaced support cables and a traction cable arranged therebetween;

a plurality of vehicles each having a carriage with two opposed lateral sides and an upper side, each lateral side being supported on one of said support cables with said traction cable extending along said upper side;

actuatable cable clamp means on each carriage for engaging said traction cable from below said traction cable;

each cable clamp means having an open condition and a closed condition and including actuation means to effect a change from said open condition to said closed condition and from said closed condition to said open condition for coupling and uncoupling the carriage of each vehicle to and from said traction cable;

means connecting each cable clamp means with its respective carriage for relative elevational movement therebetween irrespective of the condition of said cable clamp means; and adjustment means engageable with each said cable clamp means for effecting said elevational movement of the latter relative to its said respective carriage.

13. The aerial cable transport installation as defined in claim 12, wherein the adjustment means comprises positioning means provided at the stations and coacting with the cable clamp means.

14. The aerial cable transport installation as defined in claim 13, further including:

said actuatable cable clamp means are structured as toggle joints;

each of said actuatable cable clamp means having a clamp housing provided with an adjustment roll;

each of said actuatable cable clamp means including two clamp jaws;

a respective actuation roll operatively connected with each clamp jaw;

said movable lever means engaging at said housing of each related cable clamp; and said positioning means coacting with the adjustment rolls of the actuatable cable clamp means.

15. An aerial cable transport installation comprising:

a plurality of cables including two substantially horizontally spaced support cables and a traction cable arranged therebetween;

a plurality of vehicles each having a carriage with a lengthwise direction, two opposed lateral sides and an upper side, each lateral side being supported on one of said support cables with said traction cable extending along said upper side;

a transverse carrier extending between said opposed lateral sides of each carriage and having two ends;

wheels attached to said transverse carrier at each of said two ends thereof for supporting said two opposed lateral sides on a respective one of said support cables;

actuatable cable clamp means on each carriage for engaging said traction cable from below said traction cable;

each cable clamp means having two jaws movable between an open condition and a closed condition and including actuation means to effect a movement from said open condition to said closed condition and from said closed condition to said open condition for coupling and uncoupling the carriage of each vehicle to and from said traction cable;

means extending substantially in said lengthwise direction connecting each cable clamp means with said transverse carrier of the respective carriage for relative elevational movement therebetween irrespective of the condition of said cable clamp means; and adjustment means engageable with each said actuatable cable clamp means for effecting said elevational movement of the latter relative to said transverse carrier.

* * * * *